US005138660A

United States Patent [19]

Lowe et al.

[11] Patent Number: 5,138,660

[45] Date of Patent: Aug. 11, 1992

[54] SOUND IMAGING APPARATUS CONNECTED TO A VIDEO GAME

[75] Inventors: Danny D. Lowe; John W. Lees, both of Calgary, Canada

[73] Assignee: Q Sound Ltd., Calgary, Canada

[21] Appl. No.: 447,057

[22] Filed: Dec. 7, 1989

[51] Int. Cl.[5] ..... H04S 5/00

[52] U.S. Cl. ..... 381/17

[58] Field of Search ..... 381/17, 1, 18; 364/410

[56] References Cited

U.S. PATENT DOCUMENTS

| | | | |
|---|---|---|---|
| 4,188,504 | 2/1080 | Kasuga et al. | 381/17 |
| 4,574,391 | 3/1986 | Morishima | 381/18 |
| 4,685,134 | 8/1987 | Wine | 381/17 |
| 4,792,974 | 12/1988 | Chace | 381/17 |

*Primary Examiner*—Forester W. Isen

*Attorney, Agent, or Firm*—Lewis H. Eslinger; Jay H. Maioli

[57] ABSTRACT

Sound location information provided in the game program of a video game is employed by a sound processor to produce two-channel sound signals that provide an apparent location of a sound source to the video game player that need not correspond to the actual locations of the loudspeakers. The sound processor processes the sound signals produced by an audio synthesizer of the kind known for use in a video game system in accordance with audio information contained in the game program cartridge. The sound processor can be connected to the central processing bus along with the audio synthesizer. Alternatively, the sound processor can be connected to a separate audio synthesizer, both of which are connected to the video game system through a parallel bus provided therein for communication with the central processing unit bus. In another approach, the sound processor and synthesizer are connected to the video game system through a serial or parallel port provided therein for communication with the central processing unit.

16 Claims, 3 Drawing Sheets

SOUND IMAGING APPARATUS CONNECTED TO A VIDEO GAME

BACKGROUND OF THE INVENTION

1. Field of the Invention

This invention relates generally to interactive video games and, more specifically, to apparatus for utilizing sound location information in the video game program and adapting a video game system for utilizing that sound location information.

2. Description of the Background

Interactive video games are now so well-known and commonplace that practically everyone has either played one of these games or has watched such games being played by others. Video games are available for use at home utilizing the regular television receiver or television monitor that is present in the home, or video games can be played in an arcade-type situation, in which each game has its own video screen and sound playback equipment.

Generally, although the interactive video games have now become sophisticated in their video displays, the audio portion of the game has not been as well developed. For that reason, it has been proposed to employ a sound imaging system, such as described and disclosed in U.S. Pat. No. 5,046,097 issued Sep. 3, 1991 and assigned to the assignee hereof. The disclosure of this above-identified patent application is incorporated herein by reference. In that application, a system is disclosed whereby the apparent location of sounds produced by two, spaced-apart speakers can be controlled so that the location of the sound source appears to the listener to be at a point other than the actual location of the speakers. This is accomplished by using empirically derived transfer functions that operate on a plurality of monaural input signals. The two-channel output signals produced by each transfer function, each with a frequency dependent differential phase and amplitude relationship, are summed to provide a two-channel output. The phase and amplitude adjustments are made individually for successive frequency bands over the audio spectrum. The transfer function can be implemented by a digital filter and, generally, a separate transfer function is required for each discrete location from which the sound apparently emanates. Use of this sound location system will greatly enhance the audio program material that goes along with the interactive video game. Nevertheless, the interconnection of the video game subsystems and the replacement of some existing subsystems to provide a commercially viable system has become problematical.

OBJECTS AND SUMMARY OF THE INVENTION

Accordingly, it is an object of the present invention to provide a video game sound system that is a marked improvement over such sound systems known heretofore.

It is another object of the present invention to provide apparatus whereby a video game provides improved audio material by employing sound location information in the video game programs, such as in the interchangeable game cartridges or the like.

A further object of this invention is to provide a sound processor and an audio synthesizer of the kind typically employed in a video game that are connected to the central processing unit through the parallel central processing unit bus.

A still further object of the present invention is to provide a sound processor and an audio synthesizer located externally to the game base unit and that are connected to the central processing unit by way of a serial or parallel port or that are connected thereto by an extension of the central processing unit bus.

Another object of the present invention is to provide an audio synthesizer and sound processor contained within the housing of the hand-held, video game control unit, so that the video game can provide an enhanced audio program by utilizing sound location information provided in the video game program material, such as in the game cartridge.

According to an aspect of the present invention, monaural sound signals, as typically produced by the audio synthesizer connected to the central processing unit of the video game by a central processing unit bus, are fed to a sound processor that also receives sound location information derived from the game program material and fed thereto by the same central processing unit bus, whereby the monaural sound signals produced by the synthesizer are processed in accordance with the sound location information to produce two-channel sound signals having a differential phase and amplitude relationship therebetween on a frequency dependent basis, in accordance with predetermined transfer function contained within the sound processor. The predetermined transfer function can be implemented by a digital filter and, generally, a separate transfer function is required for each discrete sound location. The values making up the transfer function over the audio spectrum are derived empirically. The thusly produced two-channel sound signals for each monaural input signal are summed to produce a two-channel output. In addition, a separate audio synthesizer along with a sound processor can be connected to the central processing unit by way of a serial or parallel port or by way of an extension of the central processing unit bus. For example, the sound processor and audio synthesizer can be arranged in the hand-held control unit, so that sound information contained on the game cartridge can be passed through the central processing unit by a serial port to the sound synthesizer and sound processor to produce two-channel sound signals.

The above and other objects, features, and advantages of the present invention will become apparent from the following detailed description of illustrated embodiments thereof, to be read in conjunction with the accompanying drawings, in which like-reference numerals represent the same or similar elements.

DETAILED DESCRIPTION OF PREFERRED EMBODIMENTS

Figure 1:
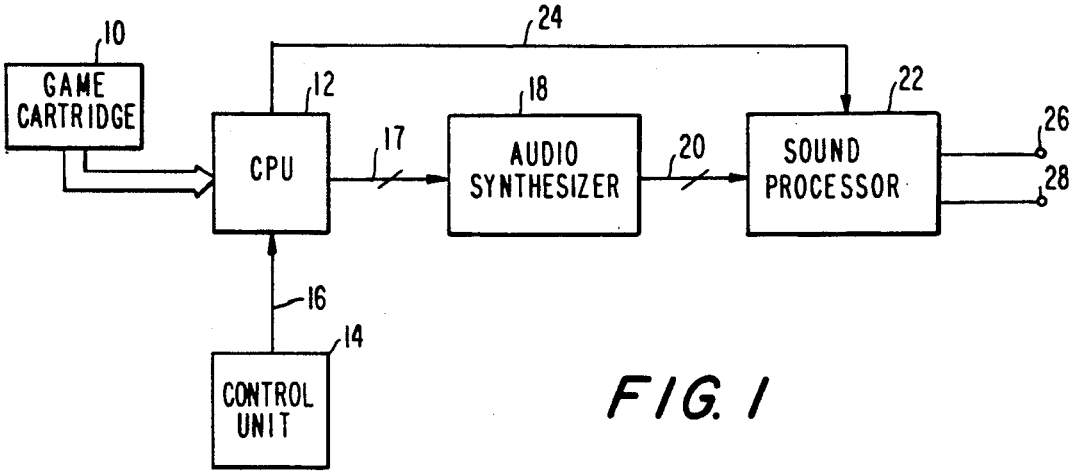
FIG. 1 is a schematic in block diagram form of an interactive video game system employing a sound processor for producing two-channel sound signals derived from a monaural sound signal and sound location information contained within a game cartridge, according to an embodiment of the present invention.

In FIG. 1, a video game cartridge 10 of the kind typically intended for insertion into a base unit (not shown) of the video game is provided that contains in addition to the typical video and audio game program data, sound location data that can be ultimately utilized by the system of FIG. 1 to provide sounds produced by two speakers, in which the sound appears to the listener to be at a location other than the actual location of the speakers. More specifically, game cartridge 10 is intended to be plugged into the base unit and the information contained therein is fed into a central processing unit 12, which forms the heart of the microcomputer used in all video games presently available. Because these games are interactive, a control unit 14 that is held and operated by the game player is connected to central processing unit 12 by a suitable cable 16 so that the user can interact with the events of the game as they proceed.

Central processing unit 12 provides on multi-lines or bus 17 sound or audio data or cues from cartridge 10 to an audio synthesizer 18 that produces synthesized audio signals on multi-lines or bus 20. In the typical video game these monaural sound signals on lines 20 from synthesizer 18 would normally be combined and fed to the speaker of the video monitor associated with the game or to the speaker of the arcade game. According to the present invention, however, these monaural sound signals produced by audio synthesizer 18 are fed to a sound processor 22 that also receives sound location data on multi-lines or bus 24 fed through central processing unit 12 from game cartridge 10.

Sound processor 22 processes these monaural sound signals produced by sound synthesizer 18 in response to the sound location information from game cartridge 10 to produce two-channel sound signals. Each of these two-channel sound signals, which correspond to a monaural input signal, have a differential amplitude and phase relationship, which is based upon a respective transfer function that is contained within sound processor 22. The transfer functions may be achieved using digital filters and, generally, for each location of the sound a different transfer function is employed. The important criterion is the differential relationship of the phase and amplitude on a frequency dependent basis between the two output signals. The two-channel output signals for each monaural input signal are summed in sound processor 22 to provide the two-channel outputs at terminals 26 and 28.

The signal on line 24 is utilized by sound processor 22 to determine which transfer function is to be utilized and also to determine whether or not the sound signals produced by the sound synthesizer 18 should even be processed through the transfer function or whether they should be fed directly to the loudspeakers without any processing at all.

Figure 2:
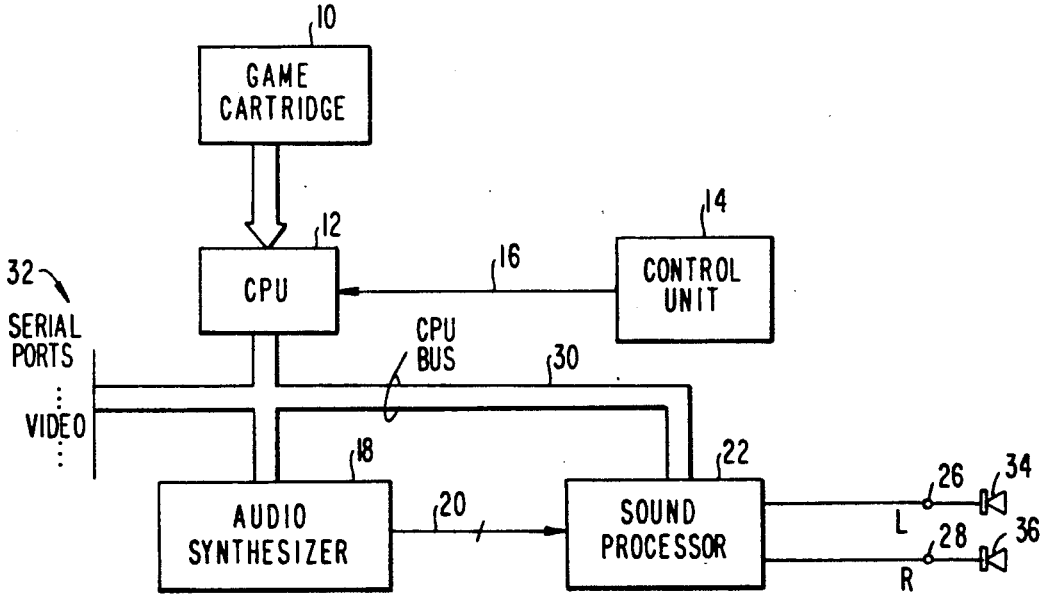
FIG. 2 is a schematic in block diagram form showing the system of FIG. 1 in more detail.

The system of FIG. 1 is shown in more detail in FIG. 2, in which central processing unit (CPU) 12 is connected to audio synthesizer 18 and sound processor 22 by way of a CPU bus 30. Accordingly, the commands and instructions for synthesizer 18 can be passed in parallel along CPU bus 30, and the sound location information from game cartridge 10 can also be passed by CPU 12 to sound processor 22 on CPU bus 30. The output of synthesizer 18 may be on a single line, if the outputs are multiplexed, or the output can be on the plurality of lines 20, each of which represents a specific monaural sound signal. These monaural sound signals are fed to sound processor 22, wherein the signals are passed through the digital filters. CPU bus 30 is also connected typically to one or more serial ports, shown typically at 32, that are used for connection to the video monitor and the like.

The two-channel sound signals output from sound processor 22 appearing at output terminals 26 and 28 are fed to appropriate speakers 34, 36, respectively. These output signals could also be fed to earphones as well as any other external loudspeakers. It should be noted that although a two-channel output seems to imply a stereo signal, such is not necessarily the case, because stereo signals do not have the differential phase and amplitude relationship on a frequency dependent basis as do the two-channel signals produced by this embodiment of the present invention.

Figure 3:
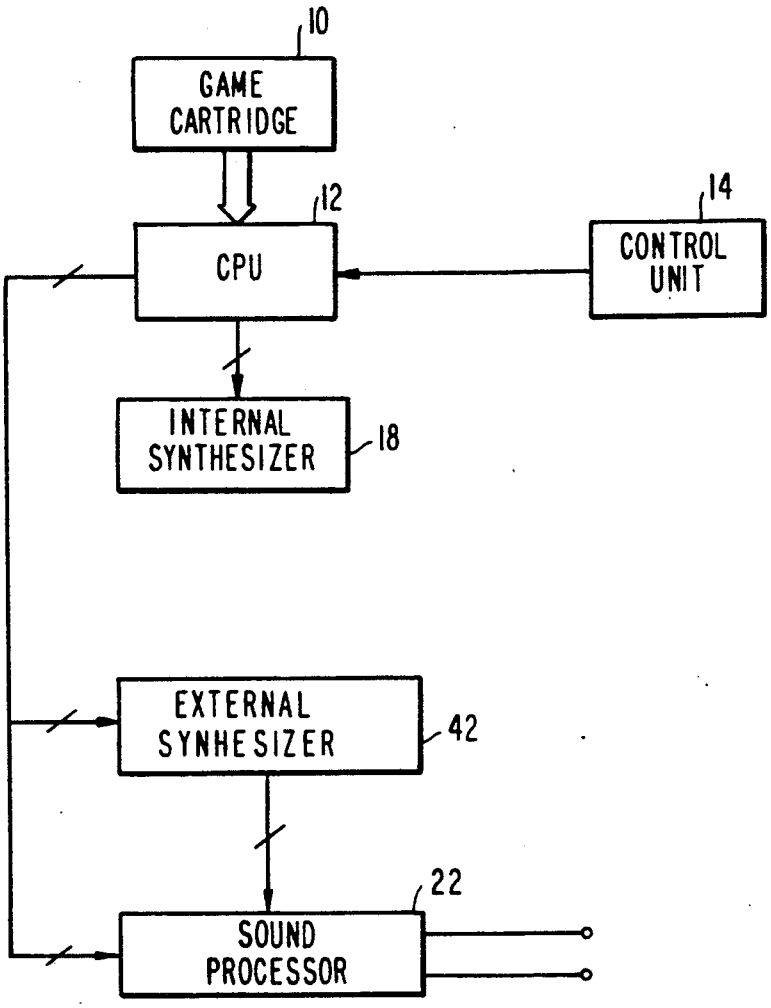
FIG. 3 is a schematic in block diagram form of a sound processor and audio synthesizer arranged externally to a video game base unit.

In the embodiment of FIG. 3, the present invention is intended to provide sound processing that may be easily adapted to existing video games, many of which already have a serial or parallel port or an extension of the CPU bus that is normally available. In fact, the CPU bus extension is simply covered over by a plastic plate on the bottom of the base unit, and upon removal of such plate, a cable from sound processor 22 can be directly connected to CPU bus 30 and to audio synthesizer 18. This makes it easy to adapt a present video game to play game cartridges that include sound location information, so as to produce two-channel sound signals giving an apparent source of the game sounds to the user that is other than the actual location of the two audio transducers.

In some video games presently available, the audio synthesizer is part of one of the integrated circuits forming the microcomputer of the video game and, therefore, in practice it can not be accessed. In this case, according to the present invention a separate, external audio synthesizer is connected to sound processor 22 and the internal audio synthesizer is bypassed, all of which can still occur by suitable connection to the serial port or the parallel port or the CPU bus extension that is a part of most video games systems.

Figure 4:
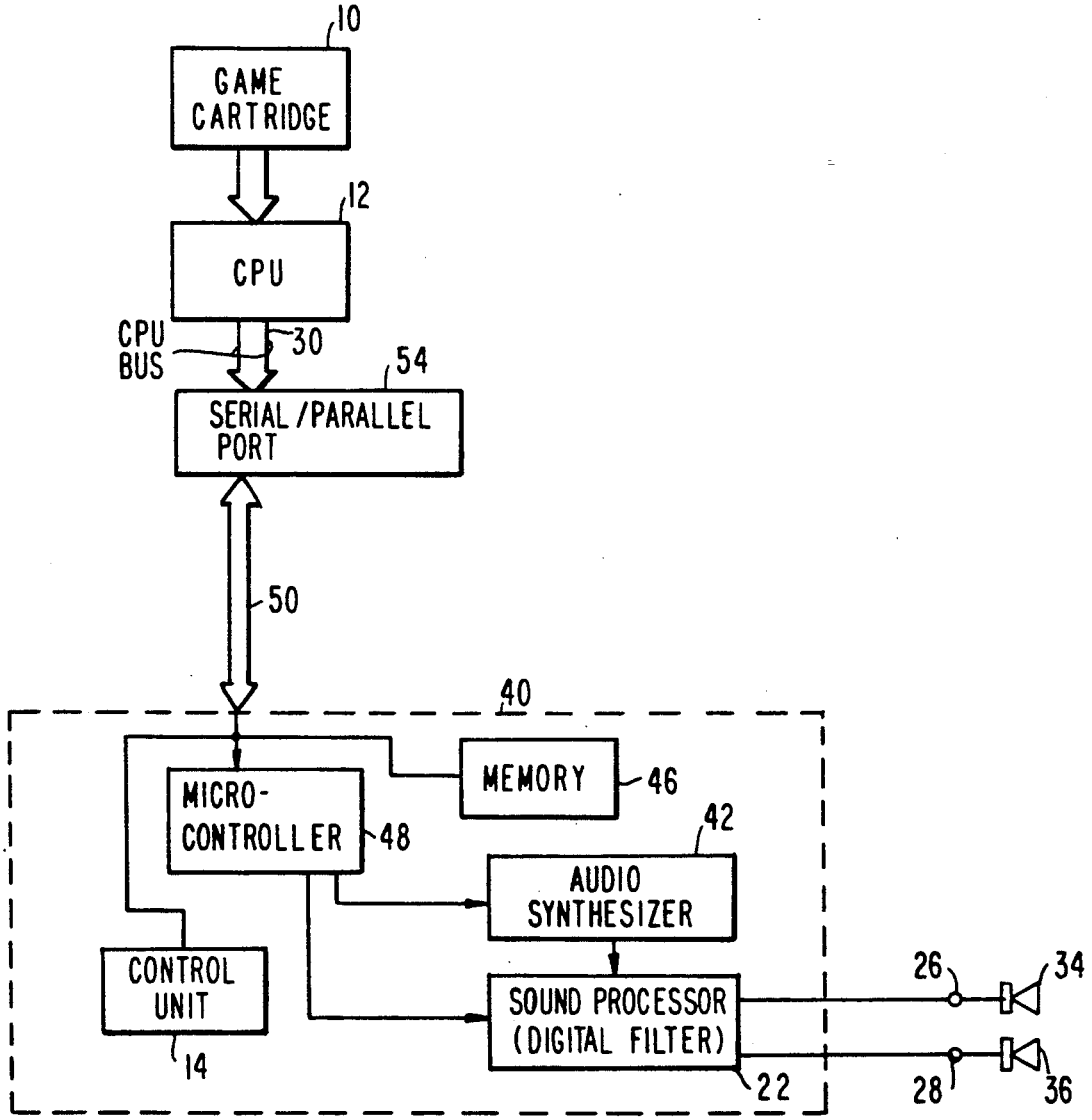
FIG. 4 is a schematic in block diagram form of a video game in which a sound processor and audio synthesizer are provided for location within the hand-held control unit for producing two-channel sound signals based upon sound location information derived from the game cartridge according to an embodiment of the present invention.

FIG. 4 represents another embodiment of the present invention in which sound processor 22, which utilizes the sound location information contained in game cartridge 10, is arranged within the same housing 40 that contains hand-held control unit 14. This embodiment is useful when the CPU bus extension in the base unit of the existing video game is not available, so that the serial or parallel port connection for control unit 14 must be employed.

Sound processor 22 and new external audio synthesizer 42 are provided in the same housing as control unit 14 and these units communicate with CPU 12 by way of a serial or parallel port connected to the central processing unit bus. Specifically, a multi-line cable 50 from control unit 14 is connected to the serial or parallel port 54 that is connected to CPU bus 30. In addition to separate, external audio synthesizer 42 and sound processor 22, because of data rate limitations of the serial or parallel port connection between synthesizer 42 and game cartridge 10 and CPU 12, a memory 46 is useful for retaining the audio program information from game cartridge 10 for subsequent use by a microcontroller 48, which controls the feeding of the sound information to audio synthesizer 42. The sound location information is fed to sound processor 22 through microcontroller 48 and is controlled by CPU 12 in accordance with the play of the game.

The above description is given on preferred embodiments of the invention, but it will be apparent that many other modifications and variations could be effected by one skilled in the art without departing from the spirit or scope of the novel concepts of the invention, which should be determined by the appended claims.

What is claimed is:

1. In a video game system, apparatus for producing sounds on a pair of speakers, such that the sounds appear to the game player to emanate from a location other than the locations of the speakers, the video game system including a central processing unit and a sound synthesizer arranged inside a base unit and a game cartridge for insertion into the base unit and including video display data, audio data, and sound location data for controlling a sound location by selecting a transfer function during audio signal processing, comprising:

a second sound synthesizer arranged external to the base unit and connected to the central processing unit for producing monaural sound signals based on the audio data from the game cartridge; and sound processor means arranged external to the base unit and connected to the central processing unit and to said second sound synthesizer for processing said monaural sound signals produced by said second sound synthesizer in accordance with selected transfer functions of said sound processor means that are selected in response to the sound location data from the game cartridge to produce two-channel sound signals within the audio frequency range having a differential phase and amplitude on a frequency dependent basis between channels, said two-channel signals being fed to the pair of speakers for reproducing the audio frequency range signals.

2. The apparatus of claim 1, further comprising a central processing unit bus extension connected to the central processing unit and wherein said second sound synthesizer and said sound processor means are arranged in a common housing external to the base unit and are connected to the central processing unit by said central processing unit bus extension.

3. The apparatus of claim 1, further comprising a central processing unit bus connected to a serial port and wherein said second sound synthesizer and said sound processor means are connected to the central processing unit by said serial port.

4. The apparatus of claim 1, further comprising a central processing unit bus connected to a parallel port and wherein said second sound synthesizer and said sound processor means are connected to the central processing unit by said parallel port.

5. The apparatus of claim 1, further comprising a housing separate from said base unit and containing said second sound synthesizer and said sound processor means.

6. The apparatus of claim 1, wherein said second sound processor includes at least one digital filter for providing the selected transfer functions and for operating on said monaural sound signals in response to the sound location data prior to being fed to the speakers.

7. The apparatus of claim 1, in which the video game system includes a control unit for operation by a game player to control the game and a central processing unit bus connecting the central processing unit to a serial data port, said control unit being connected for communicating with said central processing unit via said serial data port, and wherein said control unit includes a housing external to the base unit and said second sound synthesizer and said sound processor means are arranged within said housing.

8. The apparatus of claim 7, further comprising a microcontroller and a memory arranged in said housing of said control unit and being connected to said serial data port, so that said memory receives for storage all audio data from the game cartridge through the microcontroller, said microcontroller subsequently receives commands from said central processing unit for supplying said stored audio data from said memory to said second sound synthesizer and supplying said sound location data to said sound processor means, whereby said sound processor produces said two-channel sound signals from monaural sound signals output from said second sound synthesizer.

9. The apparatus of claim 1, in which the video game system includes a control unit for operation by a game player to control the game and a central processing unit bus connecting the central processing unit to a parallel data port, said control unit being connected for communicating with said central processing unit via said parallel data port, and wherein said control unit includes a housing external to the base unit and said second sound synthesizer and said sound processor means for arranged within said housing.

10. The apparatus of claim 9, further comprising a microcontroller and a memory arranged in said housing of said control unit and being connected to said parallel data port, so that said memory receives for storage all audio data from the game cartridge through the microcontroller, said microcontroller subsequently receives commands from said central processing unit for supplying said stored audio data from said memory to said second sound synthesizer and for supplying said sound location data to said sound processor means, whereby said sound processor produces said two-channel sound signals from monaural sound signals output from said second sound synthesizer.

11. Apparatus for use with a video game for producing a sound image for playback on a pair of speakers that provide a game player with an apparent sound-emanating location different than the locations of the speakers, the video game being of the kind employing a central processing unit and a sound synthesizer in a base unit, the apparatus comprising:

a video game cartridge for insertion into the base unit and including video display data, audio data, and sound image location data for controlling a sound location by selecting a transfer function during audio signal processing;

a housing, separate and apart from the base unit;

external sound synthesizer means arranged in said housing external to the base unit and connected to the central processing unit for producing monaural sound signals based on the audio data from the video game cartridge; and external sound processor means arranged in said housing external to the base unit and connected to the central processing unit and to said external sound synthesizer means for processing said monaural sound signals produced by said external sound synthesizer means in response to the sound image location data from the game cartridge, said sound processor means operating on the monaural sound signals within the audio frequency range in accordance with selectable transfer functions thereof that are selected in response to said sound image location data from said video game cartridge to produce two-channel sound signals having a differential phase and amplitude therebetween on a frequency dependent basis, and two-channel signals being fed to the pair of speakers for producing the sound image to the game player.

12. The apparatus of claim 11, in which the video game further includes a central processing unit bus and wherein said external sound synthesizer means and said external sound processor means are connected to the central processing unit by said central processing unit bus.

13. The apparatus of claim 11, wherein said external sound processor mean includes at least one digital filter providing the selectable transfer functions for operating on said monaural sound signals in response to said sound location data prior to being fed to said pair of speakers.

14. The apparatus of claim 11, in which the video game includes a hand-held control unit for operation by a game player and a central processing unit bus connecting the central processing unit to a serial data port, said control unit being connected for communicating with said central processing unit via said serial data port and said central processing unit bus, and wherein said control unit and said external sound synthesizing means and said external sound processor means are arranged inside said housing.

15. The apparatus of claim 14, further comprising a microcontroller and a memory also arranged in said housing and connected to said serial data port so that said memory receives for storage all audio data from the game cartridge through the microcontroller, said microcontroller subsequently receives commands from said central processing unit for supplying said stored audio program data from said memory to said sound synthesizer means and said sound location data to said sound processor means, whereby said sound processor produces said two-channel sound signals from monaural outputs of said external sound synthesizer means.

16. The apparatus of claim 15, further comprising conductor means connecting the pair of speakers to the sound processor means arranged in said housing.

* * * * *